US007588309B2

(12) United States Patent
Nakashima

(10) Patent No.: US 7,588,309 B2
(45) Date of Patent: Sep. 15, 2009

(54) IMAGE FORMING APPARATUS

(75) Inventor: Atsuhisa Nakashima, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 433 days.

(21) Appl. No.: 11/363,153

(22) Filed: Feb. 28, 2006

(65) Prior Publication Data

US 2006/0192809 A1 Aug. 31, 2006

(30) Foreign Application Priority Data

Feb. 28, 2005 (JP) ..... 2005-052324

(51) Int. Cl.
*B41J 2/165* (2006.01)

(52) U.S. Cl. ..... 347/22; 347/31; 347/32; 347/33

(58) Field of Classification Search ..... 347/22, 347/31–32, 33
See application file for complete search history.

(56) References Cited

U.S. PATENT DOCUMENTS

| | | | | |
|---|---|---|---|---|
| 4,489,863 | A * | 12/1984 | Horchos et al. | 222/504 |
| 5,225,853 | A | 7/1993 | Kobayashi et al. | |
| 2004/0046852 | A1 * | 3/2004 | Pham et al. | 347/104 |
| 2004/0263596 | A1 * | 12/2004 | Watanabe et al. | 347/94 |

FOREIGN PATENT DOCUMENTS

| | | | | |
|---|---|---|---|---|
| JP | 7047681 | | 2/1995 | |
| JP | 2000-127362 | A | 5/2000 | |
| JP | 2000202984 | A * | 7/2000 | 347/33 |
| JP | 2000309111 | | 7/2000 | |
| JP | 2000347256 | | 12/2000 | |
| JP | 2002-337352 | A | 11/2002 | |
| JP | 2003231276 | | 8/2003 | |
| JP | 2003-326738 | A | 11/2003 | |
| JP | 2004196505 | | 7/2004 | |
| JP | 2005-000767 | A | 1/2005 | |

OTHER PUBLICATIONS

European Search Report (4 pages) in corresponding European patent application.
Japan Patent Office; Office Action in Japanese Patent Application No. 2005-052324 (counterpart to the above- captioned U.S. patent application) mailed Jun. 2, 2009.

* cited by examiner

*Primary Examiner*—Julian D Huffman
*Assistant Examiner*—Jason S Uhlenhake
(74) *Attorney, Agent, or Firm*—Baker Botts L.L.P.

(57) ABSTRACT

Cleaning liquid stored in a first storage tank is absorbed by a sponge via a passage formed in a tube and a holder, and then applied onto a conveyance belt when the sponge comes into contact with the conveyance belt. Here, even when air bubbles enter into the cleaning liquid supplied to the sponge, the air bubbles are discharged to the outside through an air discharging hole formed in the holder.

14 Claims, 5 Drawing Sheets

IMAGE FORMING APPARATUS

CROSS-REFERENCE TO RELATED APPLICATIONS

This Nonprovisional application claims priority under 35 U.S.C §119(a) on Patent Application No. 2005-052324 filed in Japan on Feb. 28, 2005, the entire contents of which are hereby incorporated by reference.

BACKGROUND

The present invention aims at providing an image forming apparatus capable of reliably applying cleaning liquid onto a conveyance belt.

In the prior art, image forming apparatuses are known in which ink is ejected from nozzles perforated in a recording head, toward a recording medium placed on a conveyance belt so that an image is formed on the recording medium. Image forming apparatuses of this type have a problem that, for example, when page-margin free printing is performed, ink can be adhered to the conveyance belt conveying the recording medium, and that the adhered ink can then be transferred to the recording medium.

In order to solve this problem, for example, Japanese Patent Application Laid-Open No. 2004-196505 discloses a technique that a tank for storing cleaning liquid is connected to an absorber via a tube so that the cleaning liquid is absorbed from the tank to the absorber via the tube. Then, when the absorber having absorbed the cleaning liquid contacts with the surface of the conveyance belt, the cleaning liquid is applied onto the conveyance belt, while the applied cleaning liquid is wiped away by a blade so that the ink adhered to the conveyance belt is removed.

SUMMARY

Nevertheless, in the technique disclosed in Japanese Patent Application Laid-Open No. 2004-196505 described above, air bubbles can enter from the tube into the cleaning liquid in the course that the cleaning liquid is supplied from the tank to the absorber. Then, for example, when the absorber is composed of a porous body such as sponge, the air bubbles having entered clog in the absorber, and then the cleaning liquid is not applied onto the conveyance belt in a portion where the air bubbles have clogged. This has caused a problem that the ink on the conveyance belt cannot be removed.

Therefore, in order to solve the above-mentioned problem, and it is an object to provide an image forming apparatus capable of reliably applying cleaning liquid onto a conveyance belt.

In order to achieve this object, an image forming apparatus according to the first aspect is an image forming apparatus comprising: a recording head having a nozzle surface provided with nozzles for ejecting ink; an endless conveyance belt for circulating around in order to convey a recording medium to a position that opposes the nozzle surface of said recording head; an absorber capable of coming into contact with said conveyance belt and absorbing cleaning liquid to be applied onto said conveyance belt; and a first storing unit for storing cleaning liquid to be supplied to said absorber, characterized by further comprising: a passage forming member connected to said absorber and said first storing unit, forming a passage for supplying, to said absorber, cleaning liquid stored in said first storing unit, and having an air discharging hole for discharging, to the outside, air bubbles contained in said cleaning liquid.

In the image forming apparatus according to the first aspect, the cleaning liquid stored in the first storing unit is absorbed by the absorber via the passage formed in the passage forming member, and then applied onto the conveyance belt when the absorber comes into contact with the conveyance belt. At that time, even when air bubbles enter into the cleaning liquid supplied to the absorber, the air bubbles are discharged to the outside through the air discharging hole. This suppresses the occurrence of a problem that air bubbles having entered into the cleaning liquid clog in the absorber so that the cleaning liquid is not sufficiently applied from the absorber onto the conveyance belt. Thus, an effect is achieved that the cleaning liquid is sufficiently applied onto the conveyance belt so that a blot on the conveyance belt is removed.

The above and further objects and features will more fully be apparent from the following detailed description with accompanying drawings.

DETAILED DESCRIPTION OF THE EXEMPLARY EMBODIMENTS

Figure 1:
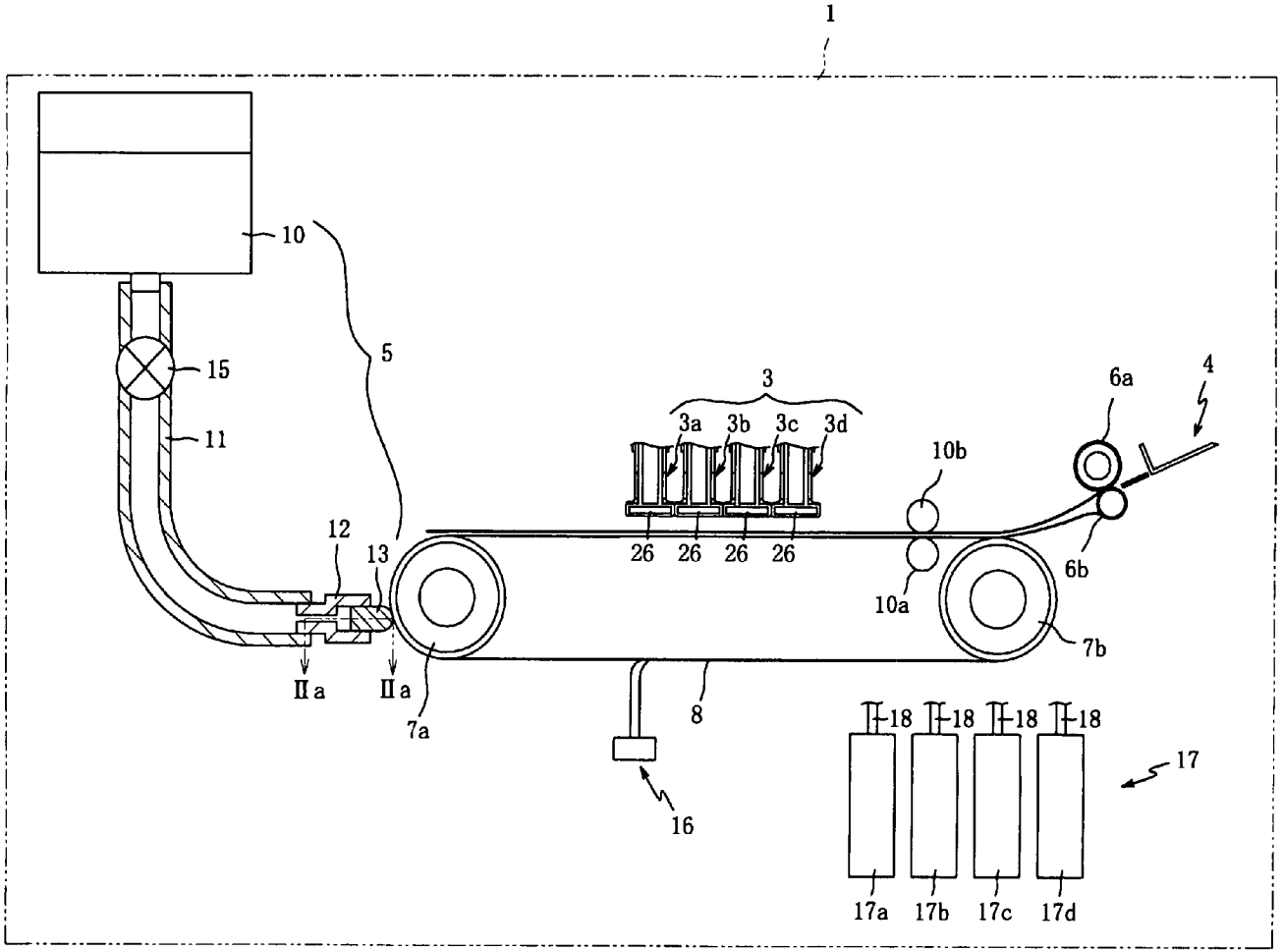
FIG. 1 is a schematic diagram showing the internal configuration of an ink jet printer serving as an image forming apparatus.

Preferred embodiments are described below with reference to the accompanying drawings. FIG. 1 is a schematic diagram showing the internal configuration of an ink jet printer 1 (referred to as a "printer 1", hereafter) serving as an image forming apparatus. The printer 1 is a color ink jet printer having a head unit 3. The head unit 3 includes four recording heads 3*a*-3*d* corresponding to inks of four colors consisting of cyan, magenta, yellow, and black.

Each of the recording heads 3*a*-3*d* is formed in an approximate rectangular shape in a sectional view, and extends in the width direction perpendicular to the conveying direction of the recording medium. These recording heads are arranged and positioned closely to each other. Further, each of the recording heads 3*a*-3*d* has a head body 26 at its lower end. Each head body 26 extends in the width direction perpendicular to the conveying direction of the recording medium, and is arranged such that its bottom surface should oppose a conveyance belt 8. In the bottom surface of the head body 26, a large number of nozzles each having a minute diameter are provided in the longitudinal direction of the head body 26 across the entire width of a recording medium to be conveyed. That is, the printer 1 is a line type printer. The recording heads 3*a*-3*d* need be positioned at the above-mentioned position only in recording operation and flushing operation described later. In other occasions, the recording heads may be located at other positions.

In an ink jet method, in order to maintain or recover the performance of ink ejected from the nozzles, a flushing process is performed in which ink is ejected from the nozzles as a process other than the recording operation. The flushing process resolves clogging in the nozzles resulting from dried ink, and discharges air bubbles mixed in the ink. In the present embodiment, the flushing process is performed by ejecting ink from the nozzles onto the conveyance belt 8. The ink ejected onto the conveyance belt in the flushing process is removed from the conveyance belt 8 when cleaning liquid is applied onto the conveyance belt 8 by a sponge 13 (absorber) described later, and then the adhered ink and the cleaning liquid are wiped away by a blade 16. In addition to the flushing process, also in frameless recording, ink may be adhered to the conveyance belt 8. Also in this case, the adhered ink can be removed by the same method described above.

Thus, the flushing process can be performed without the necessity that the head unit 3 should retract from above the conveyance belt 8. Further, the flushing process can be performed without the necessity of providing a mechanism for moving the conveyance belt 8 (belt rollers 7*a* and 7*b* and the like) downward relative to the head body 26 in order that a maintenance unit for receiving ink ejected from the nozzles should be inserted between the bottom surface of the head body 26 and the conveyance belt 8. This avoids the necessity of a large mechanism for moving the head unit 3 or the conveyance belt 8 as well as a space for their retraction, and hence permits size reduction in the main body of the apparatus.

The head body 26 is arranged in such a manner that a small gap is formed between its bottom surface and the conveyance surface of the conveyance belt 8. Then, a recording medium conveyance path is formed in the gap portion. In this configuration, when a recording medium conveyed on the conveyance belt 8 sequentially passes immediately under the four head bodies 26, ink drops of each color are ejected from the nozzles onto the upper surface, that is, the printing surface, of the recording medium. As a result, a desired color image is formed on the recording medium.

Further, in the recording medium conveyance path, a sheet feed tray 4 is provided on the upstream side of the head unit 3 (right side in FIG. 1). The sheet feed tray 4 is constructed so as to accommodate a plurality sheets of recording media. A pair of feed rollers 6*a* and 6*b* are provided immediately on the downstream side of the sheet feed tray 4. The recording media accommodated in the sheet feed tray 4 is nipped and conveyed by the feed rollers 6*a* and 6*b*, and then and transported from the right side to the left side in FIG. 1.

On the downstream side of the feed rollers 6*a* and 6*b*, pressing members 10*a* and 10*b* composed of a pair of roller members are arranged each over or under the conveyance belt 8 positioned therebetween. The pressing members 10*a* and 10*b* press the recording medium against the conveyance surface of the conveyance belt 8 in order that the recording medium on the conveyance belt 8 should not be floated from the conveyance surface, and thereby cause the recording medium to reliably be stuck onto the conveyance surface.

The conveyance belt 8 is an endless belt that circulates around in the shape of a loop, and is wound around two belt rollers 7*a* and 7*b* arranged each on the upstream side or the downstream side of the recording medium conveyance path relative to the head unit 3 positioned therebetween. The outer periphery surface, that is, the conveyance surface, of the conveyance belt 8 is subjected to silicon treatment. Thus, the recording medium conveyed by a pair of the feed rollers 6*a* and 6*b* is retained on the conveyance surface of the conveyance belt 8 by the sticking force thereof, while the recording medium is conveyed toward the downstream side (left side in FIG. 1) in association with the rotation of one belt roller 7*a* in the counterclockwise direction.

The recording medium having been fed from the sheet feed tray 4 onto the conveyance belt 8 is conveyed by the conveyance belt 8, thereby passes the opposite surface (bottom surface of the head body 26) of the head unit 3, and then moves toward a paper discharge unit not shown. On the other hand, after having conveyed the recording medium, the conveyance belt 8 moves around the belt roller 7*a* on the downstream side of the recording medium conveyance path, and further moves (returns) under the belt rollers 7*a* and 7*b* toward the belt roller 7*b*.

On the left side of the belt roller 7*a*, a cleaning liquid supply unit 5 is arranged. The cleaning liquid supply unit 5 applies cleaning liquid onto the conveyance belt 8, and comprises mainly: a first storage tank 10 (first storing unit) for storing cleaning liquid; a tube 11 (passage forming member, first passage forming member) an end of which is connected to the first storage tank 10; a holder 12 (passage forming member, second passage forming member) connected to the other end of the tube 11; and a sponge 13 retained by the holder 12 and arranged so as to come into contact with the conveyance belt 8. Here, the cleaning liquid may be composed of water, detergent, or the like.

In the cleaning liquid supply unit 5, the first storage tank 10 is arranged above the sponge 13. Thus, by virtue of water head difference, the cleaning liquid stored in the first storage tank 10 is transported through the passage (first passage) formed in the tube 11 and the passage (second passage) formed in the holder 12, and then absorbed by the sponge 13.

On the other hand, since the sponge 13 is arranged so as to come into contact with the conveyance belt 8, the cleaning liquid absorbed by the sponge 13 is applied onto the conveyance belt 8, and then wiped away together with the ink adhered to the conveyance belt 8, by the blade 16 described later. Thus, in comparison with the case that the ink adhered to the conveyance belt 8 is wiped away simply by the blade 16, the blot on the conveyance belt 8 is removed more satisfactorily.

It should be noted that a valve 15 is arranged between the first storage tank 10 and the holder 12 of the cleaning liquid supply unit 5. Thus, for example, when a certain failure arises in the holder 12 or the sponge 13, the valve 15 is closed so that the supply of cleaning liquid from the first storage tank 10 is shut off. This permits change or repair of the holder 12 and the sponge 13 without useless consumption of the cleaning liquid stored in the first storage tank 10.

Figure 2A:
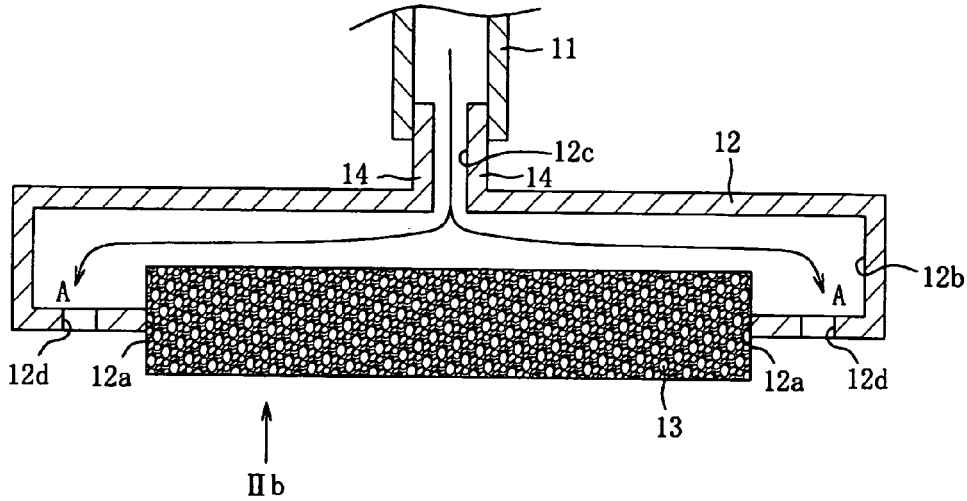
FIG. 2A is a sectional view of a holder and a sponge taken along line IIa-IIa of FIG. 1.
Figure 2B:
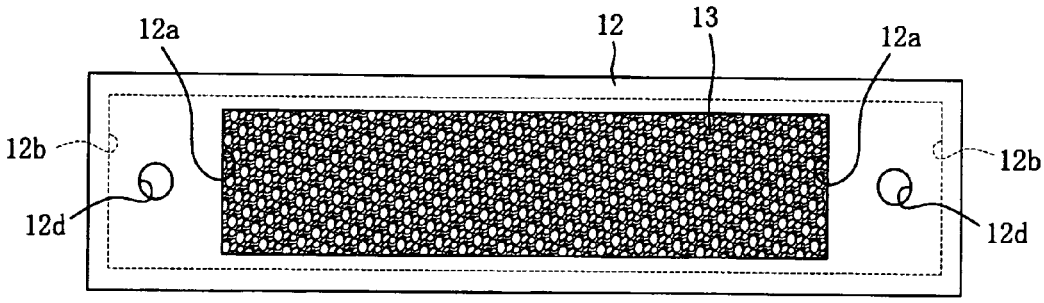
FIG. 2B is a plan view of a holder and a sponge viewed in the direction of an arrow IIb of FIG. 2A.

The holder 12 and the sponge 13 are described below in detail with reference to FIGS. 2A and 2B. FIG. 2A is a sectional view of the holder 12 and the sponge 13 taken along line IIa-IIa of FIG. 1. FIG. 2B is a plan view of the holder 12 and the sponge 13 viewed in the direction of an arrow IIb of FIG. 2A.

As shown in FIGS. 2A and 2B, the holder 12 is formed in the shape of a hollow box, and comprises: an opening 12*a* formed in the surface opposing the conveyance belt 8; an internal space 12*b* that leads to the opening 12*a*; a supply port 12*c* formed in the surface opposite to the surface which leads to the internal space 12*b* and in which the opening 12*a* is formed; and air discharging holes 12*d* formed in the same surface as the surface which leads to the internal space 12*b* and in which the opening 12*a* is formed.

The opening 12*a* causes the sponge 13 to be exposed to the conveyance belt 8 side. The contact surface of the sponge 13 is arranged so as to be exposed through the opening 12*a* and thereby come into contact with the conveyance belt 8.

The internal space 12*b* is a space for forming a part of the passage for supplying the cleaning liquid to the sponge 13. A part of the sponge 13 is retained in the holder 12 so as to occupy a part of the internal space 12*b*. A space not occupied by the sponge 13 (passage formation space, second passage) in the internal space 12*b* serves as a part of the passage for supplying the cleaning liquid to the sponge 13. The cleaning liquid stored in the passage formation space is supplied to the sponge 13.

Further, the passage formation space is formed along the sponge 13 and over a region larger than the opening 12*a*. Furthermore, the passage diameter of the passage formation space is larger than the air discharging hole 12*d*. Thus, a sufficient amount of cleaning liquid is supplied approximately uniformly over the entire sponge 13. As a result, a sufficient amount of cleaning liquid is applied onto the conveyance belt 8.

The supply port 12*c* is formed by a connection unit 14 protruding from the surface opposite to the surface in which the opening 12*a* is formed, and supplies the cleaning liquid to the internal space 12*b* via the tube 11. The connection unit 14 is arranged in an approximate center part of the longitudinal direction of the internal space 12*b* in FIG. 2A. An end of the tube 11 is inserted into the connection unit 14 so that communication is established between the passage formed in the tube 11 and the supply port 12*c*. Thus, the cleaning liquid supplied from the first storage tank 10 via the tube 11 is supplied to the internal space 12*b* via the supply port 12*c*.

Each air discharging hole 12*d* is a hole for discharging, to the outside, air bubbles having entered into the cleaning liquid through the sponge 13 or the wall surface of the tube 11. The air discharging hole 12*d* is formed at a position distant as much as possible from the connection portion between the tube 11 and the connection unit 14. In other words, the air discharging hole 12*d* is formed approximately at each tip of the passage formed by the supply port 12*c* and the internal space 12*b*.

Thus, the cleaning liquid supplied to the internal space 12*b* via the tube 11 and the supply port 12*c* flows toward both side ends where resistance is small (see arrows A in FIG. 2A). Accordingly, air bubbles having entered into the cleaning liquid are prevented from stagnating in the internal space 12*b*, and are pushed out and discharged smoothly along the flow of the cleaning liquid to the outside through the air discharging holes 12*d*.

Further, the air discharging holes 12*d* have the hole size that allows the cleaning liquid to form a meniscus. Thus, the cleaning liquid is prevented from leaking through the air discharging holes 12*d*. Furthermore, the hole size of the air discharging holes 12*d* is larger than the pore size of the sponge 13. Thus, the air bubbles are prevented from clogging in the pores of the sponge 13, so that the air bubbles having entered into the cleaning liquid are smoothly discharged to the outside through the air discharging holes 12*d*.

The sponge 13 is a porous body capable of absorbing the cleaning liquid, and is formed in the shape of an approximately rectangular parallelepiped. Further, the contact surface in contact with the conveyance belt 8 extends beyond the width of the conveyance belt 8, and is formed in an arc shape in a sectional view as shown in FIG. 1. This allows the sponge 13 to contact closely with the conveyance belt 8 and thereby apply the cleaning liquid onto the conveyance belt 8 reliably.

The following description is given with returning to FIG. 1. A blade 16 is arranged between the belt roller 7*a* and the belt rollers 7*b* and on the downstream side of the conveying direction (downstream side of the movement direction) of the conveyance belt 8 relative to the sponge 13 included in the cleaning liquid supply unit 5. The blade 16 is fabricated from resin having resistance against the ink and the cleaning liquid, and is arranged perpendicularly from below the conveyance belt 8 toward the conveyance belt 8. Its tip is arranged at a position coming into contact with the outer periphery of the returning conveyance belt 8.

Further, the blade 16 extends across the width of the conveyance belt 8, and is formed in the shape of a spatula provided with a tip which is thinner than other portions. The tip side of the spatula is formed in a manner curved toward the downstream side of the conveying direction relative to the above-mentioned perpendicular arrangement direction, so as to contact closely with the conveyance belt 8. Thus, a predetermined width of the tip of the spatula contacts closely with the conveyance belt 8, so that the ink and the cleaning liquid wiped away are prevented from being transported to the downstream side of the conveying direction relative to the blade 16.

On the left side of the blade 16, an ink cartridge 17 is arranged for storing inks supplied to the recording heads 3*a*-3*d*. The ink cartridge 17 is composed of four ink cartridges 17*a*-17*d* each for storing each of the inks of colors consisting of cyan, magenta, yellow, and black to be supplied to each of the four recording heads 3*a*-3*d*. Each of the ink cartridges 17*a*-17*d* is constructed in a manner attachable to and detachable from the printer 1, and is connected to a pump (not shown) in a state mounted on the printer 1. Then, the ink stored in each of the ink cartridges 17*a*-17*d* is supplied to each of the recording heads 3*a*-3*d* via a tube 18 connected to the pump (not shown).

Figure 3:
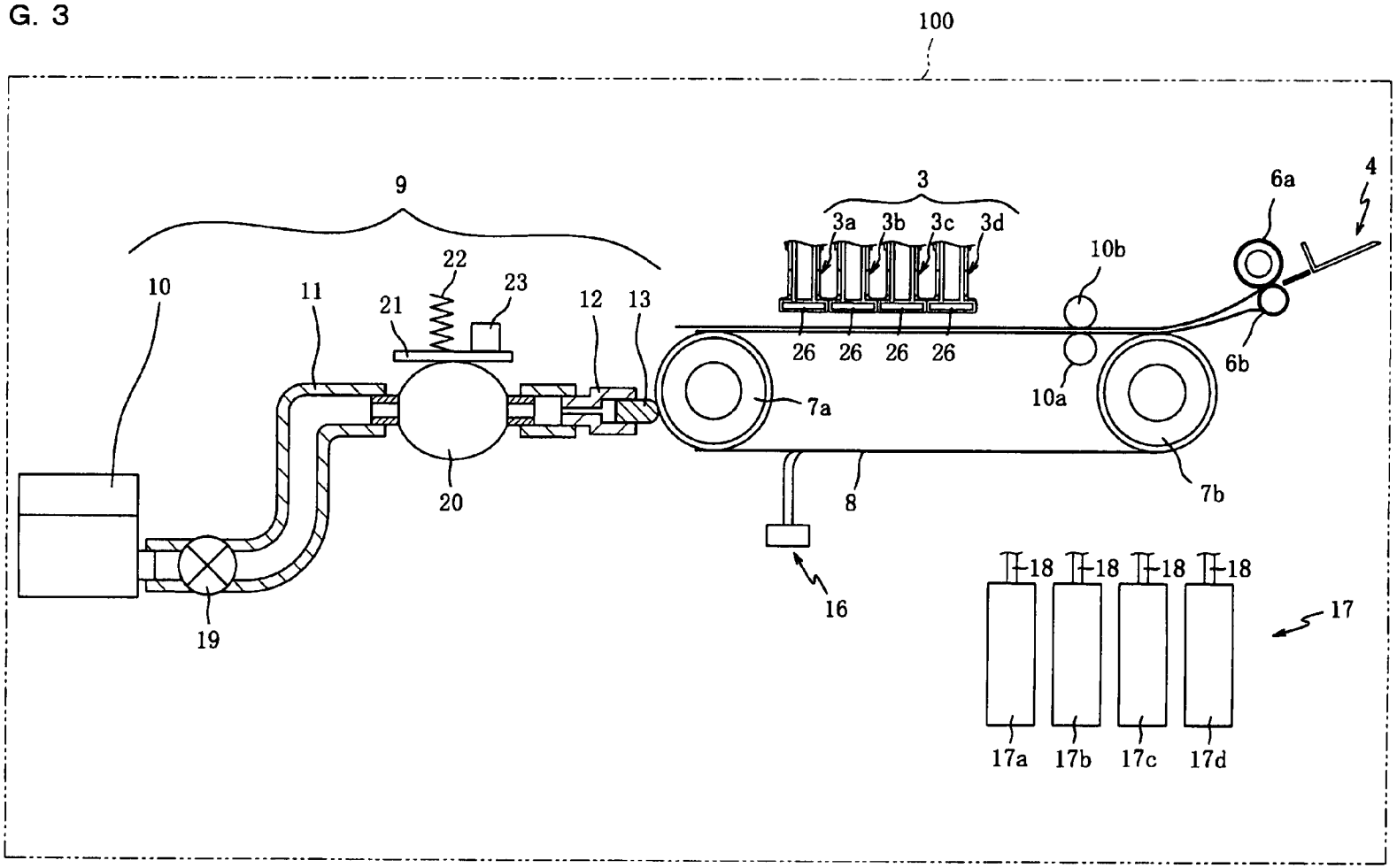
FIG. 3 is a schematic diagram showing the internal configuration of a printer incorporating a cleaning liquid supply unit according to a second embodiment.

Next, a second embodiment concerning the above-mentioned cleaning liquid supply unit 5 is described below with reference to FIG. 3. FIG. 3 is a schematic diagram showing the internal configuration of a printer 100 incorporating a cleaning liquid supply unit 9 of the second embodiment. Here, like configuration components to those described above are designated by like numerals, and hence their description is omitted.

The cleaning liquid supply unit 9 of the second embodiment comprises a first storage tank 10, a tube 11, a holder 12, and a sponge 13 which are the same as those of the cleaning liquid supply unit 5 of the first embodiment. The cleaning liquid supply unit 9 further comprises: a pump 19 arranged in the middle of the tube 11 connected to the first storage tank 10; a second storage tank 20 (first adjusting means, second storing unit) arranged between the tube 11 and the holder 12 and storing the cleaning liquid; a fluctuation plate 21 connected to the second storage tank 20; a coil spring 22 (first adjusting means, pressing member) for pressing the fluctuation plate 21; and a displacement sensor 23 (detecting means) for detecting the displacement of the fluctuation plate 21.

The pump 19 (second adjusting means) forcibly supplies the cleaning liquid stored in the first storage tank 10 to the second storage tank 20. More specifically, the pump 19 supplies a predetermined amount of cleaning liquid to the second storage tank 20 in accordance with the detection result of the displacement sensor 23 described later. In the cleaning liquid supply unit 9 of the second embodiment, the first storage tank 10 is arranged below the downstream portion in contrast to the case of the cleaning liquid supply unit 5 of the first embodiment. Thus, the cleaning liquid stored in the first storage tank 10 is forcibly supplied to the downstream side by the pump 19. When the pump 19 is provided as described here, the degree of freedom with respect to the position of arrangement of the first storage tank 10 is improved in comparison with the first embodiment.

The second storage tank 20 is constructed in the shape of a bag fabricated by sealing the edges of two flexible sheet bodies with each other, and is arranged horizontally such that its broader surface should align approximately at the same level as the sponge 13. The fluctuation plate 21 is connected to the upper surface of the second storage tank 20. In its opposite surface, the coil spring 22 is connected for biasing the fluctuation plate 21 toward the second storing unit.

Then, when the cleaning liquid absorbed in the sponge 13 is consumed, the fluctuation plate 21 is displaced downward by the pressing force of the coil spring 22 so that the cleaning liquid stored in the second storage tank 20 is forcibly supplied to the sponge 13.

Further, the displacement of the fluctuation plate 21 is monitored by the displacement sensor 23, so that when the fluctuation plate 21 is displaced downward as described above, the pump 19 is driven in accordance with the detection result of the displacement sensor 23 such that the amount of the cleaning liquid in the second storage tank 20 should be recovered by a predetermined amount of cleaning liquid. Then, a predetermined amount of cleaning liquid is supplied to the second storage tank 20 so that the fluctuation plate 21 is pushed up again. Since the displacement of the fluctuation plate 21 is monitored by the displacement sensor 23, the pump 19 is stopped when the fluctuation plate 21 is pushed up to a predetermined position.

When the cleaning liquid supply unit 9 is constructed as described here, the supply pressure is prevented from changing depending on the amount of the cleaning liquid stored in the first storage tank 10 as in the above-mentioned cleaning liquid supply unit 5 of the first embodiment where the cleaning liquid has been supplied to the sponge 13 simply by virtue of the water head difference. Accordingly, a necessary and sufficient amount of cleaning liquid can be supplied to the sponge 13 at a predetermined pressure. That is, the cleaning liquid can stably be supplied to the sponge 13.

Figure 4A:
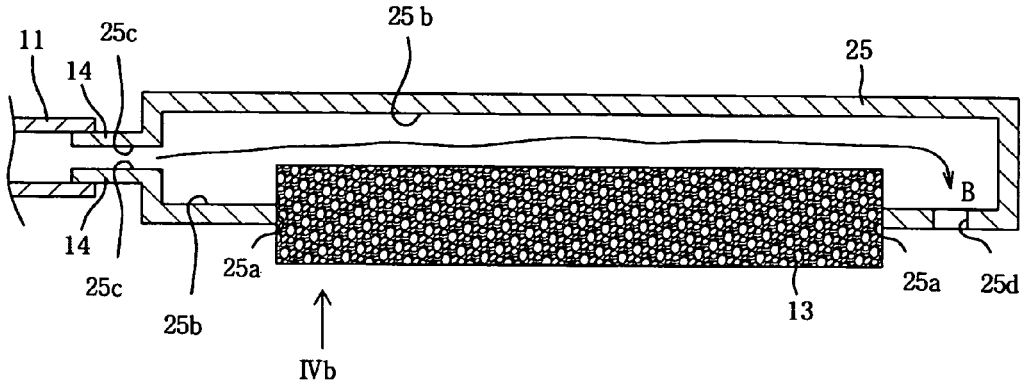
FIG. 4A is a sectional view of a holder and a sponge according to a second embodiment, corresponding to FIG. 2A.
Figure 4B:
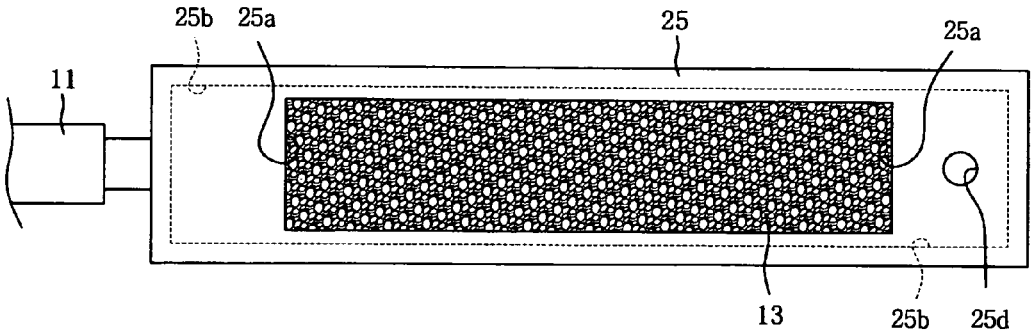
FIG. 4B is a plan view of a holder and a sponge according to a second embodiment, viewed in the direction of an arrow IVb of FIG. 4A, corresponding to FIG. 2B.

Next, the second embodiment concerning the above-mentioned holder 12 is described below with reference to FIGS. 4A and 4B. FIG. 4A is a sectional view of a holder 25 and a sponge 13 according to the second embodiment, corresponding to FIG. 2A. FIG. 4B is a plan view of the holder 25 and the sponge 13 of the second embodiment, viewed in the direction of an arrow IVb of FIG. 4A, corresponding to FIG. 2B. Here, like configuration components to those described above are designated by like numerals, and hence their description is omitted.

In the above-mentioned holder 12 of the first embodiment, the supply port 12*c* has been arranged in the approximate center part of the internal space 12*b* such that the cleaning liquid should flow through the internal space 12*b* in a bifurcated manner (see arrows A in FIG. 2A), while the air discharging holes 12*d* have been formed at both side ends.

In the holder 25 (passage forming member, second passage forming member) of the second embodiment, as shown in FIGS. 4A and 4B, the supply port 25*c* is arranged at an end of the internal space 25*b*, while the air discharging hole 25*d* is formed at the opposite end of the supply port 25*c* which is a position distant as much as possible from the supply port 25*c* (in other words, approximately at a tip position of the passage).

Also in the case that the holder 25 is constructed as described here, as described above, the cleaning liquid supplied to the internal space 25*b* via the tube 11 and the supply port 25*c* flows toward the other side end where resistance is small (see an arrow B in FIG. 4A). Accordingly, air bubbles having entered into the cleaning liquid are prevented from stagnating in the internal space 25*b*, and are pushed out and discharged smoothly along the flow of the cleaning liquid to the outside through the air discharging hole 25*d*.

Figure 5:
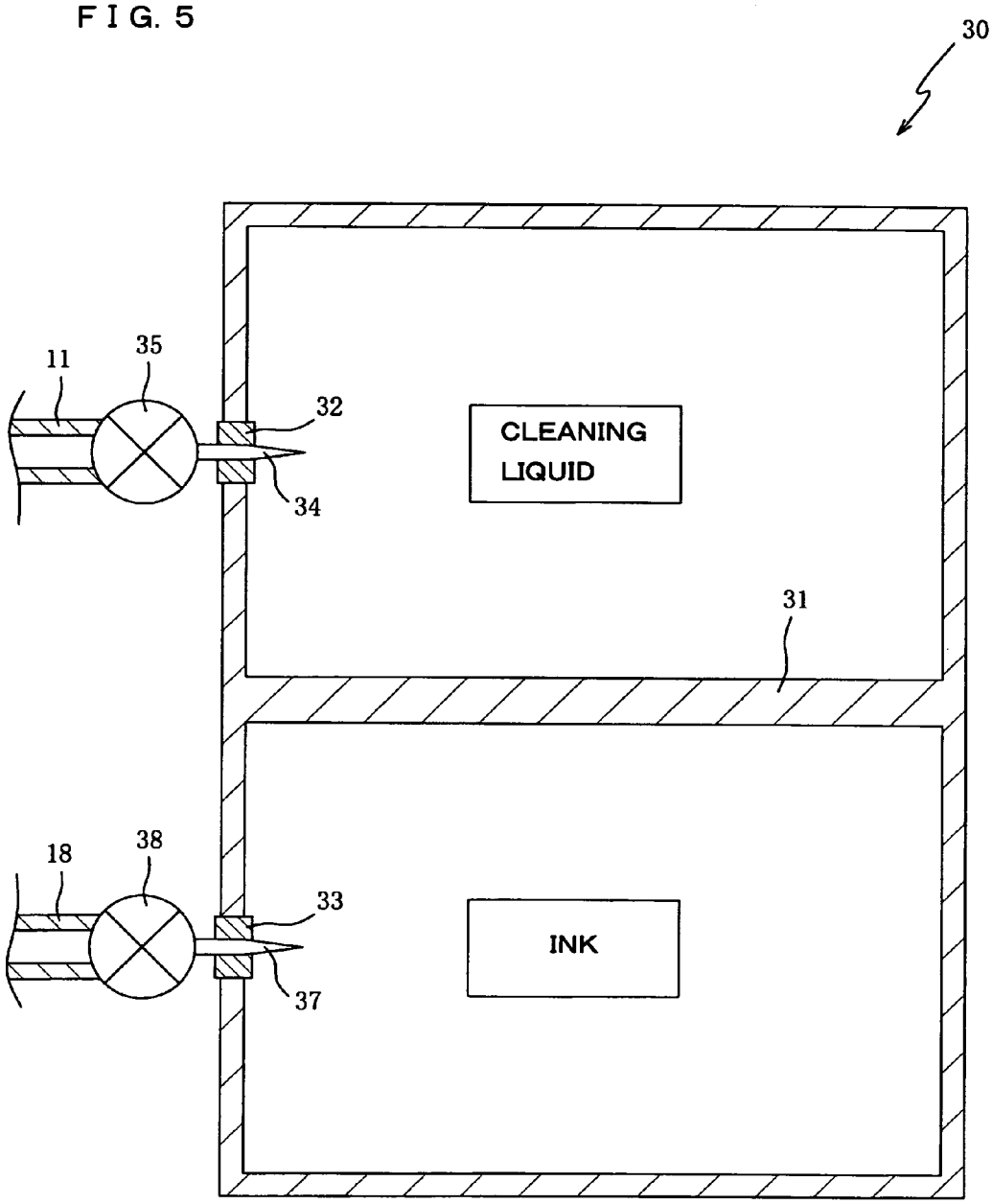
FIG. 5 is a sectional view showing the internal structure of an ink cartridge according to a second embodiment.

Next, the second embodiment concerning the above-mentioned ink cartridges 17*a*-17*d* is described below with reference to FIG. 5. FIG. 5 is a sectional view showing the internal structure of an ink cartridge 30 (ink tank) of the second embodiment. The ink cartridges 17*a*-17*d* described above stores solely the ink to be supplied to the recording heads 3*a*-3*d*. In contrast, the ink cartridge 30 of the second embodiment is constructed so as to store also the cleaning liquid in addition to the ink.

Specifically, the ink cartridge 30 is formed approximately in the shape of a hollow box. Its inside is partitioned into two spaces by a partition wall 31. Then, one space stores the cleaning liquid, while the other space stores the ink. Further, in a side wall of each space, a cap 32 or 33 made of rubber is fitted by pressing.

When the ink cartridge 30 is mounted on the printer 1, each of needles 34 and 37 connected to each of pumps 35 and 38 is pierced through each of the caps 32 and 33, so that the cleaning liquid stored in the ink cartridge 30 is supplied to the sponge 13 via the needle 34, the pump 35, and the tube 11. On the other hand, the ink stored in the ink cartridge 30 is supplied to each of the recording heads 3*a*-3*d* via the needle 37, the pump 38, and the tube 18. According to the ink cartridge 30, the cleaning liquid can be changed at the same time as the change of the ink cartridge 30. Thus, time and effort associated with the change is reduced in comparison with the case that the ink and the cleaning liquid are changed separately.

Although the configuration has been described and illustrated on the basis of the embodiments, it can be readily understood that it is not limited to the above-mentioned embodiments, and numerous modifications and variations can be devised without departing from the scope.

For example, a pump may be provided in place of the valve 15 of the cleaning liquid supply unit 5 of the first embodiment described above, while a sub-tank capable of storing the cleaning liquid may be arranged between the pump and the holder 12 at a position above the sponge 13, and while a sensor is arranged for detecting the amount of the cleaning liquid in the sub-tank. In this case, the pump is driven in accordance with the change in the amount of the cleaning liquid in the sub-tank detected by the sensor, so that a predetermined amount of cleaning liquid should be supplied to the sub-tank. Also in this alternative configuration, the cleaning liquid can stably be supplied to the sponge 13 in comparison with the case that the cleaning liquid is directly supplied from the first storage tank 10 to the sponge 13.

Further, the above-mentioned embodiments have been described for the case that one or two air discharging holes 12*d* or 25*d* have been provided. However, the number of the air discharging holes is not limited to one or two, and may be three or more as long as air bubbles can be discharged.

Further, the ink cartridge 30 of the second embodiment has been described for the case that the inside of the ink cartridge 30 is partitioned up and down, so that the cleaning liquid is stored in the upper part while the ink is stored in the lower part. However, the cartridge may be partitioned into right and left parts. Further, the space for storing the cleaning liquid and the space for storing the ink may have different sizes with each other, depending on the consumption rate of the cleaning liquid and the consumption rate of the ink. Furthermore, the pumps 35 and 38 may have different performance. Such approaches reduce the amount of the cleaning liquid and the ink discarded uselessly.

As this description may be embodied in several forms without departing from the spirit of essential characteristics thereof, the present embodiment is therefore illustrative and not restrictive, since the scope is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus comprising:

a recording head having a nozzle surface provided with nozzles for ejecting ink;

an endless conveyance belt for circulating around in order to convey a recording medium to a position that opposes the nozzle surface of said recording head;

an absorber capable of coming into contact with said conveyance belt and absorbing cleaning liquid to be applied onto said conveyance belt;

a first storing unit for storing cleaning liquid to be supplied to said absorber; and a passage forming member connected to said absorber and said first storing unit, forming a passage for supplying, to said absorber, cleaning liquid stored in said first storing unit, and having an air discharging hole for discharging, to the outside, air bubbles contained in said cleaning liquid, wherein said passage forming member comprises:

a first passage forming member connected to said first storing unit and forming a first passage in which the cleaning liquid stored in said first storing unit flows; and a second passage forming member connected to the first passage forming member and said absorber, and forming a second passage for supplying, to said absorber, the cleaning liquid having flowed in from said first passage, and wherein said air discharging hole is formed in said second passage forming member, and said second passage forming member has an opening formed in a part thereof and an internal space that leads to the opening, wherein said absorber is retained so as to occupy a part of the internal space in a manner exposed through said opening.

2. The image forming apparatus according to claim 1, wherein said absorber is composed of a porous body capable of absorbing said cleaning liquid, and wherein said air discharging hole has a size allowing the cleaning liquid to form a meniscus and is larger than a pore size of said absorber.

3. The image forming apparatus according to claim 1, wherein said air discharging hole is smaller than a passage diameter of said second passage.

4. The image forming apparatus according to claim 1, further comprising a first adjusting unit arranged in a middle of said passage forming member and adjusting an amount of the cleaning liquid to be supplied to said absorber.

5. The image forming apparatus according to claim 4, wherein said first adjusting unit comprises: a second storing unit arranged approximately at the same level as said absorber and having flexibility that permits storing of said cleaning liquid; and a pressing member for pressing the second storing unit at a predetermined pressure.

6. The image forming apparatus according to claim 5, further comprising:

a detecting unit for detecting an amount of the cleaning liquid stored in said second storing unit; and a second adjusting unit arranged in a middle between said first storing unit and said second storing unit and adjusting the amount of the cleaning liquid supplied from said first storing unit to said second storing unit in accordance with a detection result of said detecting unit.

7. The image forming apparatus according to claim 1, further comprising an ink tank constructed in a manner attachable to and detachable from an image forming apparatus and storing ink to be supplied to said recording head, wherein said first storing unit is arranged inside said ink tank.

8. The image forming apparatus according to claim 1, further comprising first adjusting means arranged in a middle of said passage forming member and adjusting an amount of the cleaning liquid to be supplied to said absorber.

9. The image forming apparatus according to claim 8, wherein said first adjusting means comprises:

a second storing unit arranged approximately at the same level as said absorber and having flexibility that permits storing of said cleaning liquid; and a pressing member for pressing the second storing unit at a predetermined pressure.

10. The image forming apparatus according to claim 9, further comprising:

detecting means for detecting an amount of the cleaning liquid stored in said second storing unit; and second adjusting means arranged in a middle between said first storing unit and said second storing unit and adjusting the amount of the cleaning liquid supplied from said first storing unit to said second storing unit in accordance with a detection result of said detecting means.

11. An image forming apparatus comprising:

a recording head having a nozzle surface provided with nozzles for ejecting ink;

an endless conveyance belt for circulating around in order to convey a recording medium to a position that opposes the nozzle surface of said recording head;

an absorber capable of coming into contact with said conveyance belt and absorbing cleaning liquid to be applied onto said conveyance belt;

a first storing unit for storing cleaning liquid to be supplied to said absorber; and a passage forming member connected to said absorber and said first storing unit, forming a passage for supplying, to said absorber, cleaning liquid stored in said first storing unit, and having an air discharging hole for discharging, to the outside, air bubbles contained in said cleaning liquid, wherein said passage forming member comprises:

a first passage forming member connected to said first storing unit and forming a first passage in which the cleaning liquid stored in said first storing unit flows; and a second passage forming member connected to the first passage forming member and said absorber, and forming a second passage for supplying, to said absorber, the cleaning liquid having flowed in from said first passage, and wherein said air discharging hole is formed in said second passage forming member, and said second passage forming member has an opening formed in a part thereof and an internal space that leads to the opening, wherein said absorber is retained so as to occupy a part of the internal space in a manner exposed through said opening, wherein said second passage forming member is connected to said first passage forming member on the opposite side of said opening.

12. The image forming apparatus according to claim 11, wherein said air discharging hole is located more distant from a connection portion between said first passage forming member and said second passage forming member than said opening is.

13. An image forming apparatus comprising:

a recording head having a nozzle surface provided with nozzles for ejecting ink;

an endless conveyance belt for circulating around in order to convey a recording medium to a position that opposes the nozzle surface of said recording head;

an absorber capable of coming into contact with said conveyance belt and absorbing cleaning liquid to be applied onto said conveyance belt;

a first storing unit for storing cleaning liquid to be supplied to said absorber; and a passage forming member connected to said absorber and said first storing unit, forming a passage for supplying, to said absorber, cleaning liquid stored in said first storing unit, and having an air discharging hole for discharging, to the outside, air bubbles contained in said cleaning liquid, wherein the air discharging hole is positioned above a bottom portion of the absorber.

14. The image forming apparatus according to claim 11, wherein said second passage is formed along said absorber and over a region larger than said opening.

* * * * *